US011543116B2

(12) United States Patent
Huang et al.

(10) Patent No.: US 11,543,116 B2
(45) Date of Patent: Jan. 3, 2023

(54) LIGHTING MODULE AND LIGHTING DEVICE

(71) Applicant: HANGZHOU HPWINNER OPTO CORPORATION, Hangzhou (CN)

(72) Inventors: Jianming Huang, Hangzhou (CN); Kai Chen, Hangzhou (CN)

(73) Assignee: HANGZHOU HPWINNER OPTO CORPORATION, Hangzhou (CN)

( * ) Notice: Subject to any disclaimer, the term of this patent is extended or adjusted under 35 U.S.C. 154(b) by 0 days.

(21) Appl. No.: 17/335,304

(22) Filed: Jun. 1, 2021

(65) Prior Publication Data

US 2021/0381686 A1 Dec. 9, 2021

(30) Foreign Application Priority Data

Jun. 3, 2020 (CN) ..... 202020993654.X

(51) Int. Cl.

| | |
|---|---|
| ***F21V 31/00*** | (2006.01) |
| ***F21V 29/70*** | (2015.01) |
| ***F21V 23/00*** | (2015.01) |
| ***F21V 5/00*** | (2018.01) |
| *F21Y 115/10* | (2016.01) |

(52) U.S. Cl.

CPC ..... *F21V 31/005* (2013.01); *F21V 5/007* (2013.01); *F21V 23/001* (2013.01); *F21V 29/70* (2015.01); *F21Y 2115/10* (2016.08)

(58) Field of Classification Search

CPC ..... F21V 31/005; F21V 29/70; F21V 5/007; F21V 23/001; F21Y 2115/10

See application file for complete search history.

(56) References Cited

U.S. PATENT DOCUMENTS

2018/0017247 A1 1/2018 Van Asselt et al.
2018/0045399 A1 2/2018 Chen et al.

FOREIGN PATENT DOCUMENTS

CN 201944610 U 8/2011
CN 110131695 A * 8/2019 ..... F21V 17/12

(Continued)

OTHER PUBLICATIONS

Extended European Search Report for corresponding European Application No. 21177386.6, dated Oct. 25, 2021. 8 pages.

*Primary Examiner* — Anabel Ton
(74) *Attorney, Agent, or Firm* — Leason Ellis LLP

(57) ABSTRACT

A lighting module and a lighting device are disclosed. The lighting module includes a base, a light-transmitting component and a sealing component, the base includes a bottom plate and a base sidewall, the light-transmitting component includes a light-transmitting component includes a light-transmitting component body and a light-transmitting component sidewall; the bottom plate and the light-transmitting component body are disposed opposite to each other to form an accommodation space between the bottom plate and the light-transmitting component body; the base sidewall and the light-transmitting component sidewall are disposed opposite to each other in a direction parallel to the base plate; the sealing component is located between the base sidewall and the light-transmitting component sidewall, and is in close contact with the light-transmitting component sidewall and the base sidewall, respectively, so as to seal the accommodation space.

19 Claims, 4 Drawing Sheets

(56) References Cited

FOREIGN PATENT DOCUMENTS

| | | | | | |
|---|---|---|---|---|---|
| CN | 110131695 | U | | 8/2019 | |
| EP | 2857744 | A1 | * | 4/2015 | ..... F21V 19/045 |
| JP | 2015138704 | A | * | 7/2015 | ..... F21V 11/00 |

* cited by examiner

LIGHTING MODULE AND LIGHTING DEVICE

The present application claims the priority of Chinese Utility Model No. 202020993654.X filed on Jun. 3, 2020, for all purposes, the disclosure of which is incorporated herein by reference in its entirety as part of the present application.

TECHNICAL FIELD

Embodiments of the present disclosure provide a lighting module and a lighting device.

BACKGROUND

With the continuous development of economy and the acceleration of urbanization, the market of lighting devices is also increasingly growing. Generally, the lighting device may include one or more lighting module, and the lighting module may include a light-emitting component, a sealing component and a heat sink. The light-emitting component is used for emitting light, the sealing component is used for sealing the light-emitting component, and the heat sink is used for dissipating heat of the light-emitting element.

Light-emitting diode (LED) is a semiconductor light-emitting element. Generally, the light-emitting diode includes a semiconductor chip. By applying a current to the semiconductor chip, excess energy can be released through a recombination of carriers in the semiconductor to cause photon emission, so that the semiconductor chip can emit light.

SUMMARY

Embodiments of the present disclosure provide a lighting module and a lighting device. The lighting module can seal the accommodation space through the sealing component, the light-transmitting component sidewall and the base sidewall, that is, a lateral sealing mode is provided. In such case, under the condition that an outer dimension of the lighting module is unchanged, an area of the accommodation space of the lighting module can be increased to provide more light-emitting elements (such as light-emitting diode lamp beads), so that the utilization rate of the light-emitting surface of the lighting module can be improved, and the illumination brightness and luminous efficiency of the lighting module can be raised given the same power.

At least one embodiment of the present disclosure provides a lighting module, which includes: a base, including a bottom plate and a base sidewall; a light-transmitting component, including a light-transmitting component body and a light-transmitting component sidewall; and a sealing component, the bottom plate and the light-transmitting component body are disposed opposite to each other to form an accommodation space between the bottom plate and the light-transmitting component body; the base sidewall and the light-transmitting component sidewall are disposed opposite to each other in a direction parallel to the base plate; the sealing component is located between the base sidewall and the light-transmitting component sidewall, and is in close contact with the light-transmitting component sidewall and the base sidewall, respectively, so as to seal the accommodation space.

For example, in the lighting module provided by an embodiment of the present disclosure, the light-transmitting component sidewall is located at an edge of the light-transmitting component body and extends along a direction from the light-transmitting component body towards the bottom plate, an accommodation groove is formed by the light-transmitting component sidewall and the light-transmitting component body, and the base is at least partially located in the accommodation groove, the light-transmitting component sidewall is located at a side of the base sidewall away from a center of the bottom plate.

For example, in the lighting module provided by an embodiment of the present disclosure, the base sidewall is a part of the bottom plate close to the light-transmitting component sidewall.

For example, in the lighting module provided by an embodiment of the present disclosure, the base sidewall is located at an edge of the bottom plate and extends along a direction from the bottom plate towards the light-transmitting component body, an accommodation groove is formed by the bottom plate and the base sidewall, and the light-transmitting component is at least partially located in the accommodation groove, the base sidewall is located at a side of the light-transmitting component sidewall away from a center of the bottom plate.

For example, in the lighting module provided by an embodiment of the present disclosure, the sealing component includes a sealant filled between the base sidewall and the light-transmitting component sidewall.

For example, in the lighting module provided by an embodiment of the present disclosure, the sealant is only located in a gap between the light-transmitting component sidewall and the base sidewall.

For example, in the lighting module provided by an embodiment of the present disclosure, the sealing component includes a sealing ring at least partially located between the base sidewall and the light-transmitting component sidewall, and the light-transmitting component sidewall is configured to apply a force, towards the base sidewall, to the sealing ring so that the sealing ring is in a compressed state.

For example, in the lighting module provided by an embodiment of the present disclosure, the sealing ring includes: a first sealing portion located between the base sidewall and the light-transmitting component sidewall; and a second sealing portion connected with the first sealing portion and located between the bottom plate and the light-transmitting component body, a cross section of the sealing ring constituted by the first sealing portion and the second sealing portion has an "L" shape.

For example, in the lighting module provided by an embodiment of the present disclosure, the sealing ring includes: a first sealing portion located between the base sidewall and the light-transmitting component sidewall; a second sealing portion connected with the first sealing portion and located between the bottom plate and the light-transmitting component body; and a third sealing portion connected with the first sealing portion and located at a side of the light-transmitting component body away from the bottom plate, a cross section of the sealing ring constituted by the first sealing portion, the second sealing portion and the third sealing portion has a "U" shape.

For example, in the lighting module provided by an embodiment of the present disclosure, the light-transmitting component sidewall includes: a first groove recessed into the light-transmitting component sidewall from a surface of the light-transmitting component sidewall, wherein a sidewall of the first groove close to the accommodation space is a first groove sidewall, and a sidewall of the first groove away from the accommodation space is a second groove sidewall; a first communication hole, located in the first groove sidewall and extending along a direction from the first groove to the accommodation space, so as to communicate the first groove with the accommodation space; and a second communication hole, located in the second groove sidewall and extending along a direction from the accommodation space to the first groove, so as to communicate the first groove with an external space.

For example, the lighting module provided by an embodiment of the present disclosure further includes a power line, located in the second communication hole, in the first groove and in the first communication hole, and extending from the second communication hole to the accommodation space through the first groove and the first communication hole; and a sealing material, filled in the first groove so as to seal the first groove.

For example, in the lighting module provided by an embodiment of the present disclosure, the first groove is recessed into the light-transmitting component sidewall from a surface of the light-transmitting component sidewall away from the bottom plate, and an orthographic projection of the first groove on a plane where the bottom plate is located is at least partially overlapped with an orthographic projection of a gap between the light-transmitting component sidewall and the base sidewall on the plane where the bottom plate is located.

For example, in the lighting module provided by an embodiment of the present disclosure, the first groove is recessed into the light-transmitting component sidewall from a surface of the light-transmitting component sidewall close to the bottom plate, and an orthographic projection of the first groove on a plane where the bottom plate is located is spaced apart from an orthographic projection of a gap between the light-transmitting component sidewall and the base sidewall on the plane where the bottom plate is located.

For example, in the lighting module provided by an embodiment of the present disclosure, the base sidewall includes: a second groove recessed into the base sidewall from a surface of the base sidewall, wherein a sidewall of the second groove close to the accommodation space is a third groove sidewall, and a sidewall of the second groove away from the accommodation space is a fourth groove sidewall; a third communication hole, located in the third groove sidewall and extending along a direction from the second groove to the accommodation space, so as to communicate the second groove with the accommodation space; and a fourth communication hole, located in the fourth groove sidewall and extending along a direction from the accommodation space to the second groove, so as to communicate the second groove with an external space.

For example, the lighting module provided by an embodiment of the present disclosure further includes a power line, located in the fourth communication hole, in the second groove and in the third communication hole, and extending from the fourth communication hole to the accommodation space through the second groove and the third communication hole; and a sealing material, filled in the second groove so as to seal the second groove.

For example, in the lighting module provided by an embodiment of the present disclosure, the light-transmitting component sidewall includes: a first sidewall, disposed opposite to the base sidewall in a direction parallel to the bottom plate; a second sidewall, disposed opposite to the base sidewall in the direction parallel to the bottom plate, and located at a side of the first sidewall close to the light-transmitting component body; and a first platform, connected with the first sidewall and the second sidewall, respectively, the first sidewall and the base sidewall are disposed opposite to each other to form a first gap between the first sidewall and the base sidewall, and the second sidewall and the base sidewall are disposed opposite to each other to form a second gap between the second sidewall and the base sidewall, a width of the first gap is greater than a width of the second gap.

For example, in the lighting module provided by an embodiment of the present disclosure, the light-transmitting component sidewall includes a first sidewall, disposed opposite to the base sidewall in a direction parallel to the bottom plate; a second sidewall, disposed opposite to the base sidewall in the direction parallel to the bottom plate, and located at a side of the first sidewall close to the light-transmitting component body; and a first platform, connected with the first sidewall and the second sidewall, respectively, the base sidewall includes: a third sidewall, disposed opposite to the first sidewall to form a third gap between the first sidewall and the third sidewall; a fourth sidewall, disposed opposite to the second sidewall to form the second gap between the second sidewall and the fourth sidewall; and a second platform, connected with the third sidewall and the fourth sidewall, respectively, a width of the third gap is greater than the width of the first gap.

For example, the lighting module provided by an embodiment of the present disclosure further includes a sealant, filled between the base sidewall and the light-transmitting component sidewall, a width of the second gap ranges from 0 mm to 0.6 mm, and a width of the first gap ranges from 1.9 mm to 3.0 mm.

For example, in the lighting module provided by an embodiment of the present disclosure, the light-transmitting component body is provided with a positioning post protruding towards the bottom plate; the bottom plate includes a positioning hole matched with the positioning post; and the positioning post passes through the positioning hole to position the bottom plate.

For example, in the lighting module provided by an embodiment of the present disclosure, a size of a part of the positioning hole away from the light-transmitting component body is larger than a size of a part of the positioning hole close to the light-transmitting component body.

For example, in the lighting module provided by an embodiment of the present disclosure, a size of a part of the positioning post away from the light-transmitting component body is larger than that of a part of the positioning post close to the light-transmitting component body.

For example, the lighting module provided by an embodiment of the present disclosure further includes a circuit board, located in the accommodation space; and at least one light-emitting element, located on the circuit board and configured to emit light towards the light-transmitting component, the light-transmitting component includes at least one lens portion, and the at least one lens portion is arranged in one-to-one correspondence with the at least one light-emitting element.

For example, in the lighting module provided by an embodiment of the present disclosure, the bottom plate includes a circuit board, connected with the at least one light-emitting element, and configured to drive the at least one light-emitting element to emit light.

At least one embodiment of the present disclosure further provides a lighting device, which includes any one of the abovementioned lighting module.

For example, the light device provided by an embodiment of the present disclosure further includes a heat sink, the lighting device includes a plurality of the lighting modules, and bases of the plurality of lighting modules are fixed on the heat sink so as to collectively dissipate heat through the heat sink.

BRIEF DESCRIPTION OF THE DRAWINGS

In order to more clearly illustrate the technical solutions of the embodiments of the disclosure, the drawings of the embodiments will be briefly described in the following; it is obvious that the described drawings below are only related to some embodiments of the disclosure and thus are not limitative to the disclosure.

DETAILED DESCRIPTION

In order to make objectives, technical details and advantages of the embodiments of the present disclosure more clearly, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment (s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "include," "including," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

Figure 1:
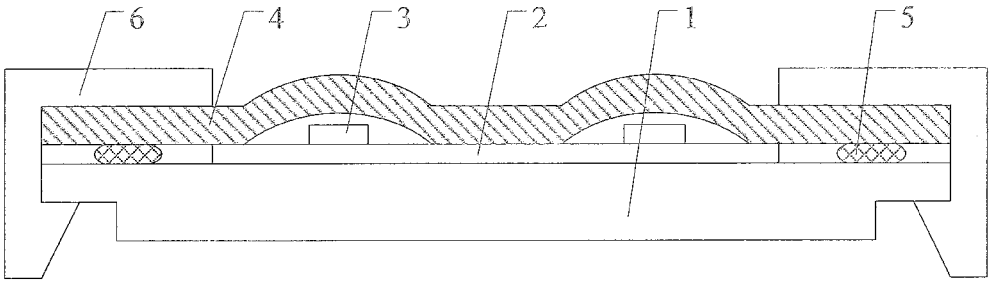
FIG. 1 is a structural diagram of a lighting module.

FIG. 1 is a structural diagram of a lighting module. As illustrated by FIG. 1, the lighting module 10 includes a base 1, a circuit board 2, a light-emitting element 3, a lens component 4 and a sealing member 5. The base 1 and the lens component 4 are disposed opposite to each other to form an accommodation space between the base 1 and the lens component 4; and the circuit board 2 and the light-emitting element 3 are located in the accommodation space. The sealing member 5 is located at an edge of the lens component 4 and the base 1, and is located between the lens component 4 and the base 1. In order to seal the accommodation space, the lighting module 10 also needs to be provided with a pressing frame 6 (which can also be a screw or a buckle) at the edge of the lens component 4 to fasten the lens component 4 and the base 1, so that the sealing member 5 is deformed under a pressure. In this way, the deformed sealing member can seal the accommodation space. However, in the lighting module shown in FIG. 1, a certain area of the edge part of the lens component will be occupied by the screw, the buckle or the pressing frame, which goes against providing more lamp beads on the circuit board, and makes it difficult to improve the brightness and the luminous efficiency of the lighting module.

In this regards, embodiments of the present disclosure provide a lighting module and a lighting device. The lighting module includes a base, a light-transmitting component and a sealing component. The base includes a bottom plate and a base sidewall; and the light-transmitting component includes a light-transmitting component body and a light-transmitting component sidewall. The bottom plate and the light-transmitting component body are disposed opposite to each other to form an accommodation space between the bottom plate and the light-transmitting component body. The base sidewall and the light-transmitting component sidewall are disposed opposite to each other; the sealing component is located between the base sidewall and the light-transmitting component sidewall, and is in close contact with the light-transmitting component sidewall and the base sidewall, respectively, so as to seal the accommodation space. Therefore, the light-emitting element can be disposed in the accommodation space and configured to emit light; furthermore, sealing the accommodation space can prevent external water and oxygen from corroding the light-emitting element, thereby prolonging the service life of the lighting module. In addition, the lighting module can seal the accommodation space through the sealing component, the light-transmitting component sidewall and the base sidewall, that is, a lateral sealing mode is provided. In such case, under the condition that an outer dimension of the lighting module is unchanged, an area of the accommodation space of the lighting module can be increased to provide more light-emitting elements (such as light-emitting diode lamp beads), so that the utilization rate of the light-emitting surface of the lighting module can be improved, and the illumination brightness and luminous efficiency of the lighting module can be raised given the same power.

Hereinafter, the lighting module and the lighting device provided by the embodiments of the present disclosure will be described in details with reference to the accompanying drawings.

Figure 2:
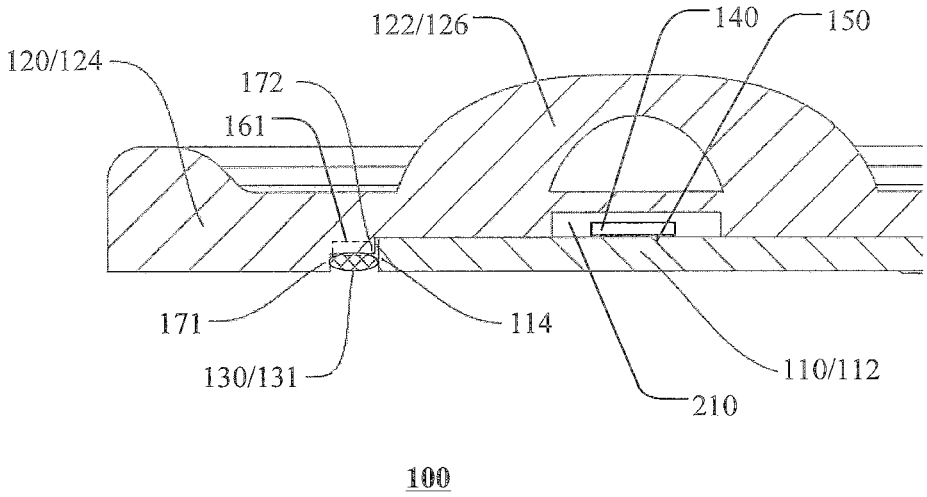
FIG. 2 is a partial structural diagram of a lighting module provided according to an embodiment of the present disclosure.

FIG. 2 is a partial structural diagram of a lighting module provided according to an embodiment of the present disclosure. As illustrated by FIG. 2, the lighting module 100 includes a base 110, a light-transmitting component 120 and a sealing component 130. The base 110 includes a bottom plate 112 and a base sidewall 114; and the light-transmitting component 120 includes a light-transmitting component body 122 and a light-transmitting component sidewall 124. The bottom plate 112 and the light-transmitting component body 122 are disposed opposite to each other to form an accommodation space 210 between the bottom plate 112 and the light-transmitting component body 122. The base sidewall 114 and the light-transmitting component sidewall 124 are disposed opposite to each other in a direction parallel to the bottom plate 112; the sealing component 130 is located between the base sidewall 114 and the light-transmitting component sidewall 124, and is in close contact with the light-transmitting component sidewall 124 and the base sidewall 114, respectively, so as to seal the accommodation space 210. It should be noted that, both the base sidewall and the light-transmitting component sidewall as described above are structures having a certain thickness but not just two-dimensional surfaces. Similarly, all the sidewalls described in the following are also structures with a certain thickness but not just two-dimensional surfaces.

In the lighting module provided by the embodiment of the present disclosure, a light-emitting element can be disposed in the accommodation space and is configured to emit light; furthermore, sealing the accommodation space can prevent external water and oxygen from corroding the light-emitting element, thereby prolonging the service life of the lighting module. Because the sealing component is disposed between the light-transmitting component sidewall and the base sidewall and is in close contact with the light-transmitting component sidewall and the base sidewall, respectively, the lighting module can seal the accommodation space through the sealing component, the light-transmitting component sidewall and the base sidewall, that is, a lateral sealing mode is provided. In such case, the lighting module does not need to be provided with additional fixing structures such as a pressing frame, a buckle or a screw at the edge of the light-transmitting component. Under the condition that the outer dimension of the lighting module is unchanged, the area of the accommodation space of the lighting module can be increased to provide more light-emitting elements (such as light-emitting diode lamp beads), so that the utilization rate of the light-emitting surface of the lighting module can be improved, and the illumination brightness and luminous efficiency of the lighting module can be raised given the same power. In addition, the lighting module can also reduce the defective rate of products, save the installation steps, improve the installation efficiency and reduce the cost, because there is no need to arrange additional fixing structures such as a pressing frame, a buckle or a screw at the edge of the light-transmitting component.

In some examples, as illustrated by FIG. 2, the light-transmitting component sidewall 124 is located at the edge of the light-transmitting component body 122 and extends along a direction from the light-transmitting component body 122 towards the bottom plate 112; an accommodation groove is formed by the light-transmitting component sidewall 124 and the light-transmitting component body 122; the base 110 is at least partially located in the accommodation groove; and the light-transmitting component sidewall 124 is located at a side of the base sidewall 114 away from a center of the base plate 112.

For example, the light-transmitting component sidewall 124 may be an enclosure wall structure surrounding the light-transmitting component body 122. In such case, the sealing component between the light-transmitting component sidewall and the base sidewall can also have a corresponding annular structure.

In some examples, as illustrated by FIG. 2, the base sidewall 114 is a part of the bottom plate 110 close to the light-transmitting component sidewall 124. Therefore, the base is simple in structure and convenient to be manufactured, thereby reducing the cost.

In some examples, as illustrated by FIG. 2, the sealing component 130 includes a sealant 131 filled between the base sidewall 114 and the light-transmitting component sidewall 124. Therefore, the accommodation space of the lighting module can be sealed by the sealant.

In some examples, as illustrated by FIG. 2, the sealant 131 is only located in a gap between the light-transmitting component sidewall 124 and the base sidewall 114. That is to say, no sealant 131 is provided between the light-transmitting component body 122 and the bottom plate 112, so that the area of the accommodation space can be increased to provide more light-emitting elements (e.g., light-emitting diode lamp beads), thereby improving the utilization rate of the light-emitting surface of the lighting module, and improving the illumination brightness and luminous efficiency of the lighting module given the same power.

In some examples, as illustrated by FIG. 2, the light-transmitting component sidewall 124 includes: a first sidewall 171, disposed opposite to the base sidewall 114 in a direction parallel to the bottom plate 112; a second sidewall 172, disposed opposite to the base sidewall 114 in the direction parallel to the bottom plate 112 and located at a side of the first sidewall 171 close to the light-transmitting component body 122; and a first platform 161 connected to the first sidewall 171 and the second sidewall 172, respectively. The first sidewall 171 and the base sidewall 114 are disposed opposite to each other to form a first gap therebetween; the second sidewall 172 and the base sidewall 114 are disposed opposite to each other to form a second gap therebetween; and a width of the first gap is greater than that of the second gap. Because the width of the first gap is greater than that of the second gap, it is easier to fill the first gap with a sealing component such as sealant in an assembling process of the lighting module. Furthermore, upon external water and oxygen penetrating through the gap between the sealing component and the first sidewall, the first platform can prevent the external water and oxygen from further penetrating into the accommodation space to a certain extent, thereby further improving the waterproof performance of the lighting module.

In some examples, the width of the above-mentioned second gap ranges from 0 mm to 0.6 mm, and the width of the first gap Si ranges from 1.9 mm to 3.0 mm. It should be noted that, in the case where the second gap, that is, the gap between the second sidewall and the base sidewall is zero, that is, the second sidewall and the base sidewall are in contact with each other, the base can just be pressed into the light-transmitting component so as to further improve the sealing effect. Of course, in the case where the second gap is not zero, the installation difficulty of the lighting module can be reduced. Therefore, the width range of the above-mentioned second gap is a preferred solution in conjunction with the consideration of waterproof sealing, glue characteristics, cost and the like.

In some examples, as illustrated by FIG. 2, the lighting module further includes at least one light-emitting element 140 and a circuit board 150. The circuit board 150 is disposed in the accommodation space 210, and the at least one light-emitting element 140 is disposed on the circuit board 150 and configured to emit light towards the light-transmitting component 120. The light-transmitting component 120 includes at least one lens portion 126, the at least one lens portion 126 is arranged in one-to-one correspondence with the at least one light-emitting element 140 so as to distribute light of the light-emitting element 140, thereby improving the light-emitting effect of the lighting module. In addition, because the circuit board 150 and the light-emitting element 130 both are located in the accommodation space, the circuit board 150 and the light-emitting element 130 can be protected against corrosion of external water and oxygen, so as to have longer service life and improved stability.

In some examples, as illustrated by FIG. 2, the circuit board 150 is electrically connected with at least one light-emitting element 140, and is configured to drive the at least one light-emitting element 140 to emit light. The circuit board 150 and the bottom board 112 are integrated into a whole, thereby improving the integration degree of the lighting module. Of course, embodiments of the present disclosure include such case but are not limited thereto, and the circuit board can also be a separate circuit board, such as a printed circuit board.

Figure 3:
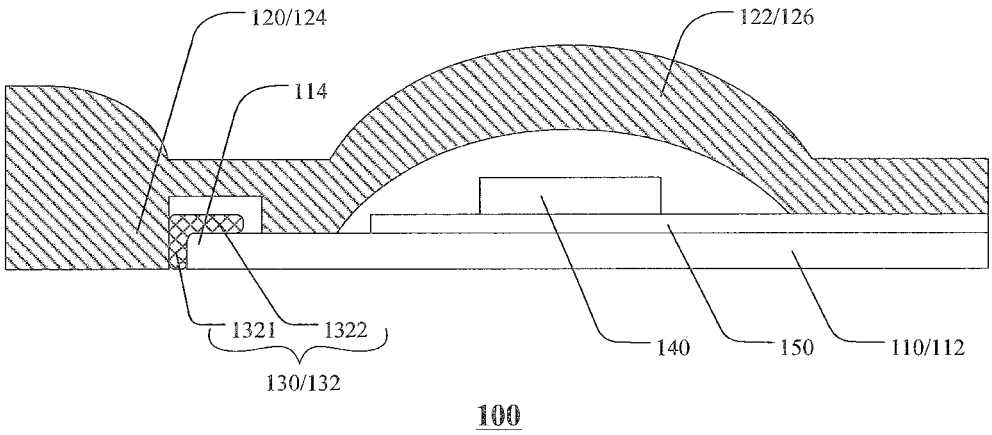
FIG. 3 is a structural diagram of another lighting module provided by an embodiment of the present disclosure.

FIG. 3 is a structural diagram of another lighting module provided by an embodiment of the present disclosure. As illustrated by FIG. 3, the sealing component 130 includes a sealing ring 132. The sealing ring 132 is at least partially located between the base sidewall 114 and the light-transmitting component sidewall 124, and the light-transmitting component sidewall 124 is configured to apply a force, towards the base sidewall 114, to the sealing ring 132, so that the sealing ring 132 is in a compressed state. Upon the sealing ring 132 being in the compressed state, it can be in close contact with the light-transmitting component sidewall 124 and the base sidewall 114, respectively, so as to seal the accommodation space 210. It is worth noting that, compared with the case where the sealing ring is applied with a force perpendicular to the bottom plate to be in the compressed state, the base sidewall and the light-transmitting component sidewall are disposed opposite to each other in the direction parallel to the bottom plate, and upon the sealing ring being compressed by a force perpendicular to the base sidewall, a size of the sealing ring in the direction perpendicular to the base sidewall is smaller, which can further improve the utilization rate of the light-emitting surface of the lighting module, and raise the illumination brightness and luminous efficiency of the lighting module given the same power.

In some examples, as illustrated by FIG. 3, the sealing ring 132 includes a first sealing portion 1321 and a second sealing portion 1322. The first sealing portion 1321 is located between the base sidewall 114 and the light-transmitting component sidewall 124. The second sealing portion 1322 is connected with the first sealing portion 1321, and is located between the bottom plate 112 and the light-transmitting component body 122. In such case, a cross section of the sealing ring 132 constituted by the first sealing portion 1321 and the second sealing portion 1322 has an "L" shape. In the case where the cross section of the sealing ring has an "L" shape, the first sealing portion is located between the base sidewall and the light-transmitting component sidewall, while the second sealing portion is located between the bottom plate and the light-transmitting component body. Therefore, not only the first sealing portion can function for sealing, but also the second sealing portion can play a role of sealing when extruded into the compressed state, thereby further improving the sealing effect of the sealing ring. In addition, the shape of the sealing ring can be stabilized by the second sealing portion, so that the sealing ring can be prevented from deforming and falling out during the installation.

Figure 4:
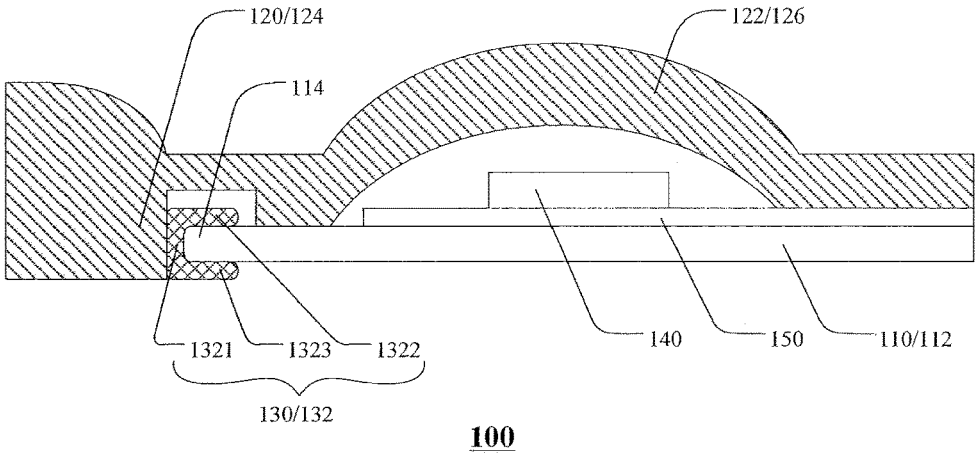
FIG. 4 is a structural diagram of another lighting module provided by an embodiment of the present disclosure.

FIG. 4 is a structural diagram of another lighting module provided by an embodiment of the present disclosure. As illustrated by FIG. 4, the sealing ring 132 includes a third sealing portion 1323, the third sealing portion 1323 is connected with the first sealing portion 1321 and is located at a side of the light-transmitting component body 122 away from the bottom plate 112. A cross section of the sealing ring 132 constituted by the first sealing portion 1321, the second sealing portion 1322 and the third sealing portion 1323 has a "U" shape. Therefore, the sealing effect of the sealing ring can be further enhanced by the third sealing portion; and upon the base being pressed into the light-transmitting component, it is not easy to be rebounded. Of course, the cross section of the sealing ring in the embodiment of the present disclosure includes such case but is not limited to be the above-mentioned "L" shape and "U" shape. The cross section of the sealing ring can also have a round shape, a horseshoe shape and other shapes, as long as the sealing effect can be achieved.

It should be noted that, compared with the sealing ring shown in FIG. 4, in the case where the cross section of the sealing ring has an "I" shape, because the sealing ring is not provided with a third sealing portion, the installed bottom plate can be on the same plane as the light-transmitting component sidewall, so that the bottom plate can be directly attached to other objects such as a lamp shell. In the case where the cross section of the sealing ring has a "U" shape as illustrated by FIG. 4, the light-transmitting component sidewall is higher than the bottom plate, so that an avoidance structure can be formed on the lamp shell or other objects.

In some examples, under a natural state, an inner circumference of the sealing ring is smaller than an outer circumference of the base sidewall, so that the sealing ring can be firmly sleeved onto the base sidewall. In addition, in the case where the inner circumference of the sealing ring is smaller than the outer circumference of the base sidewall, it can also prevent the sealing ring from jumping out.

In some examples, as illustrated by FIG. 3 and FIG. 4, the circuit board 150 and the base plate 112 are structures independent from each other, and the circuit board 150 can be fixed on the base plate 112. For example, the circuit board 150 may be fixed on the base plate 112 by screws. Of course, the embodiments of the present disclosure include such case but are not limited thereto, and the circuit board can also be fixed on the bottom board by other ways.

Figure 5:
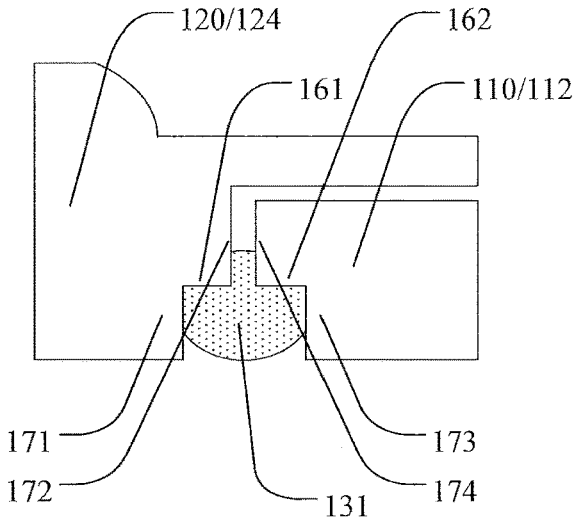
FIG. 5 is a partially enlarged diagram of a light-transmitting component sidewall and a base sidewall of a lighting module provided by an embodiment of the present disclosure.

FIG. 5 is a partially enlarged diagram of a light-transmitting component sidewall and a base sidewall of a lighting module provided by an embodiment of the present disclosure. As illustrated by FIG. 5, the light-transmitting component sidewall 124 is located at the edge of the light-transmitting component body 122, and extends along a direction from the light-transmitting component body 122 towards the bottom plate 112. An accommodation groove is formed by the light-transmitting component sidewall 124 and the light-transmitting component body 122, the base 110 is at least partially located in the accommodation groove, and the light-transmitting component sidewall 124 is located at a side of the base sidewall 114 away from the center of the bottom plate 112.

As illustrated by FIG. 5, the light-transmitting component sidewall 124 includes a first sidewall 171 and a second sidewall 172, and the second sidewall 172 is located at a side of the first sidewall 171 close to the light-transmitting component body 122. The base sidewall 114 includes a third sidewall 173 and a fourth sidewall 174. The third sidewall 173 is disposed opposite to the first sidewall 171 to form a third gap between the first sidewall 171 and the third sidewall 173. The fourth sidewall 174 is disposed opposite to the second sidewall 172 to form the second gap between the second sidewall 172 and the fourth sidewall 174, and a width of the third gap is larger than that of the second gap. The light-transmitting component sidewall 124 includes a first platform 161, which is connected with the first sidewall 171 and the second sidewall 172, respectively. The base sidewall 114 includes a second platform 162, which is connected with the third sidewall 173 and the fourth sidewall 174, respectively.

In this lighting module, because the width of the third gap is larger than that of the second gap, it is easier to fill the third gap with sealing components such as sealant during the assembling process of the lighting module. In addition, upon the sealant being filled in the third gap, the sealant can penetrate into the second gap with smaller width, thus achieving better sealing effect. On the other hand, upon the external water and oxygen penetrating through the gap between the sealing component and the first sidewall or the gap between the sealing component and the third sidewall, both the first platform and the second platform can prevent the external water and oxygen from further penetrating into the accommodation space to a certain extent, thereby further improving the waterproof performance of the lighting module.

For example, the width of the second gap ranges from 0 mm to 0.6 mm, and the width of the third gap ranges from 1.9 mm to 3.0 mm.

Figure 6:
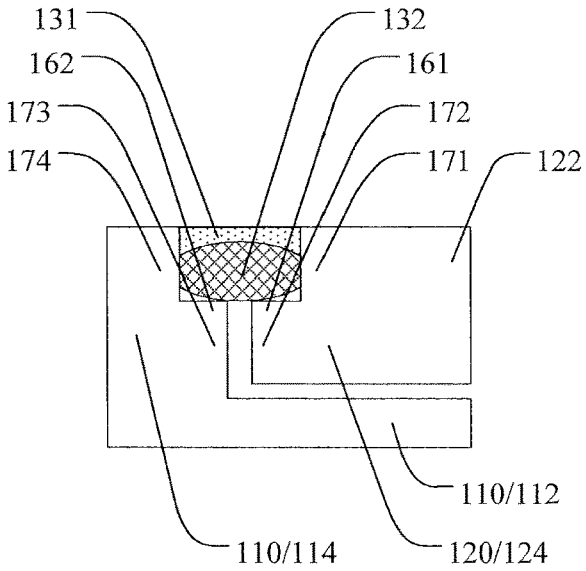
FIG. 6 is a partially enlarged diagram of a light-transmitting component sidewall and a base sidewall of another lighting module provided by an embodiment of the present disclosure.

FIG. 6 is a partially enlarged diagram of a light-transmitting component sidewall and a base sidewall of another lighting module provided by an embodiment of the present disclosure. As illustrated by FIG. 6, the base sidewall 114 is located at the edge of the bottom plate 112, and extends along the direction from the bottom plate 112 towards the light-transmitting component body 122. An accommodating groove is formed by the bottom plate 112 and the bottom sidewall 114, the light-transmitting component 120 is at least partially located in the accommodating groove, and the base sidewall 114 is located at a side of the light-transmitting component sidewall 124 away from the center of the bottom plate 112. What is different from the lighting modules shown in FIGS. 2-5 is that, the lighting module shown in FIG. 6 has an accommodating groove formed from the base, and the light-transmitting component is at least partially located in the accommodating groove.

As illustrated by FIG. 6, the light-transmitting component sidewall 124 includes a first sidewall 171 and a second sidewall 172, and the second sidewall 172 is located at a side of the first sidewall 171 close to the light-transmitting component body 122. The base sidewall 114 includes a third sidewall 173 and a fourth sidewall 174. The third sidewall 173 is disposed opposite to the first sidewall 171 to form a third gap between the first sidewall 171 and the third sidewall 173. The fourth sidewall 174 is disposed opposite to the second sidewall 172 to form the second gap between the second sidewall 172 and the fourth sidewall 174, and a width of the third gap is greater than that of the second gap. The light-transmitting component sidewall 124 includes a first platform 161, which is connected with the first sidewall 171 and the second sidewall 172, respectively. The base sidewall 114 includes a second platform 162, which is connected with the third sidewall 173 and the fourth sidewall 174, respectively. Similarly, upon external water and oxygen penetrating through the gap between the sealing component and the first sidewall or the gap between the sealing component and the third sidewall, both the first platform and the second platform can prevent the external water and oxygen from further penetrating into the accommodation space to a certain extent, thereby further improving the waterproof performance of the lighting module.

As illustrated by FIG. 6, the sealing component 130 can be a sealing ring 132, and the sealing ring 132 is disposed between the first sidewall 171 of the light-transmitting component sidewall 124 and the third sidewall 173 of the base sidewall 114. The third sidewall 173 of the base sidewall 114 is configured to apply a force, towards the first sidewall 171 of the light-transmitting component sidewall 124, to the sealing ring 132, so that the sealing ring 132 is in a compressed state. Upon the sealing ring 132 being in the compressed state, it can be in close contact with the light-transmitting component sidewall 124 and the base sidewall 114, respectively, so as to seal the accommodation space 210.

In order to further enhance the sealing performance of the sealing component, as illustrated by FIG. 6, the sealing component 130 may include both a sealing ring 132 and a sealant 131. The sealant 131 is located at a side of the sealing ring 132 away from the light-transmitting component body 122, so as to further seal the accommodation space. Of course, embodiments of the present disclosure include such case but are not limited thereto, and the sealing component can also be a separate sealing ring or a separate sealant.

Figure 7:
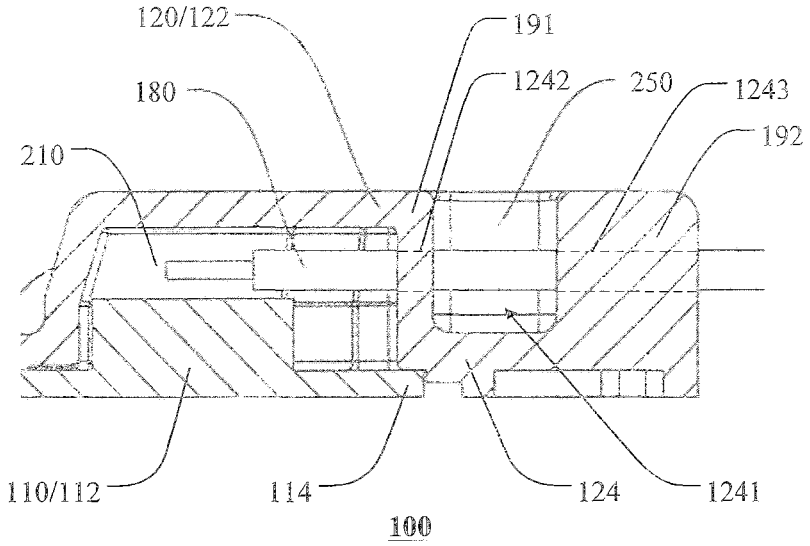
FIG. 7 is a partial structural diagram of another lighting module provided by an embodiment of the present disclosure.

FIG. 7 is a partial structural diagram of another lighting module provided by an embodiment of the present disclosure. As illustrated by FIG. 7, the light-transmitting component sidewall 124 includes a first groove 1241, a first communication hole 1242 and a second communication hole 1243. The first groove 1241 is recessed into the light-transmitting component sidewall 124 from a surface of the light-transmitting component sidewall 124. A sidewall of the first groove 1241 close to the accommodation space 210 is a first groove sidewall 191, and a sidewall of the first groove 1241 away from the accommodation space 210 is a second groove sidewall 192. The first communication hole 1242 is located in the first groove sidewall 191, and extends along a direction from the first groove 1241 to the accommodation space 210, so as to communicate the first groove 1241 with the accommodation space 210. The second communication hole 1243 is located in the second groove sidewall 192, and extends along a direction from the accommodation space 210 to the first groove 1241, so as to communicate the first groove 1241 with an external space.

In some examples, as illustrated by FIG. 7, the lighting module further includes a power line 180 located in the second communication hole 1243, the first groove 1241 and the first communication hole 1242; and the power line 180 extends from the second communication hole 1243 to the accommodation space 210 through the first groove 1241 and the first communication hole 1242, thereby supplying power to the light-emitting elements in the accommodation space. The lighting module further includes a sealing material 250 such as curable liquid glue, which is filled in the first groove 1241 to seal the first groove 1241. Therefore, the lighting module can seal the power line, and prevent external water and oxygen from entering the accommodation space through a through hole by which the power line enters the accommodation space, thereby further improving the waterproof performance of the lighting module.

In some examples, as illustrated by FIG. 7, the first groove 1241 is recessed into the light-transmitting component sidewall 124 from the surface of the light-transmitting component sidewall 124 away from the bottom plate 112, and an orthographic projection of the first groove 1241 on a plane where the bottom plate 112 is located is at least partially overlapped with an orthographic projection of the gap between the light-transmitting component sidewall 124 and the base sidewall 114 on the plane where the bottom plate 112 is located. Because the first groove does not need to penetrate through the light-transmitting component sidewall, the orthographic projection of the first groove on the plane where the bottom plate is located is at least partially overlapped with the orthographic projection of the gap between the light-transmitting component sidewall and the base sidewall on the plane where the bottom plate is located, thereby reducing the width of the light-transmitting component sidewall. Of course, embodiments of the present disclosure include such case but are not limited to this.

Figure 8:
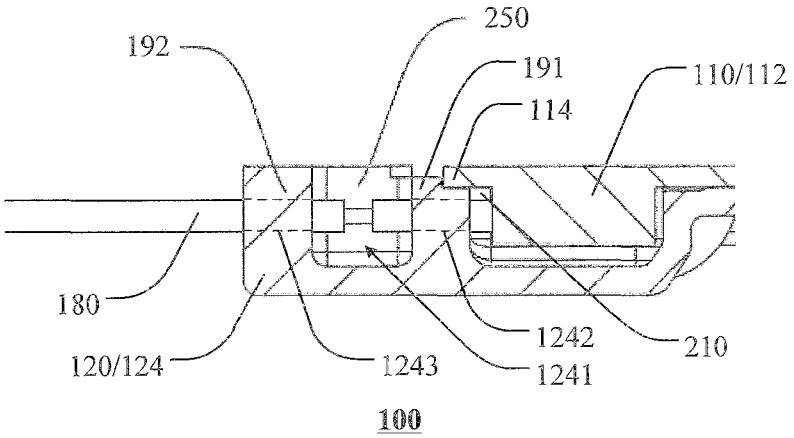
FIG. 8 is a partial structural diagram of another lighting module provided by an embodiment of the present disclosure.

FIG. 8 is a partial structural diagram of another lighting module provided by an embodiment of the present disclosure. As illustrated by FIG. 8, the light-transmitting component sidewall 124 includes a first groove 1241, a first communication hole 1242 and a second communication hole 1243. The first groove 1241 is recessed into the light-transmitting component sidewall 124 from a surface of the light-transmitting component sidewall 124. A sidewall of the first groove 1241 close to the accommodation space 210 is a first groove sidewall 191, and a sidewall of the first groove 1241 away from the accommodation space 210 is a second groove sidewall 192. The first communication hole 1242 is located in the first groove sidewall 191, and extends along a direction from the first groove 1241 to the accommodation space 210, so as to communicate the first groove 1241 with the accommodation space 210. The second communication hole 1243 is located in the second groove sidewall 192, and extends along a direction from the accommodation space 210 to the first groove 1241, so as to communicate the first groove 1241 with the external space. The first groove 1241 is recessed into the light-transmitting component sidewall 124 from a surface of the light-transmitting component sidewall 124 close to the bottom plate 112. An orthographic projection of the first groove 1241 on a plane where the bottom plate 112 is located is spaced apart from an orthographic projection of the gap between the light-transmitting component sidewall 124 and the base sidewall 114 on the plane where the bottom plate 112 is located.

Figure 9:
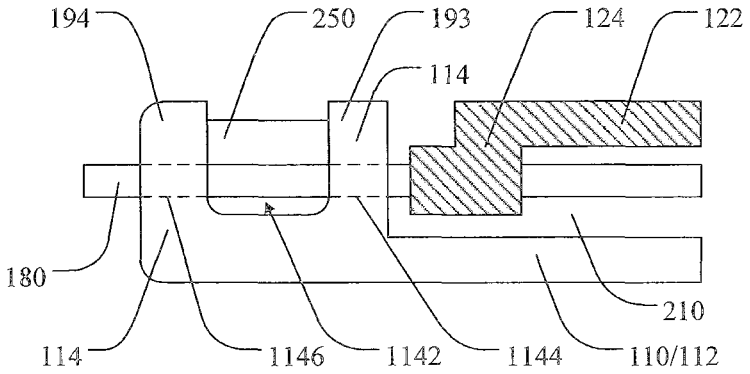
FIG. 9 is a partial structural diagram of another lighting module provided by an embodiment of the present disclosure.

FIG. 9 is a partial structural diagram of another lighting module provided by an embodiment of the present disclosure. As illustrated by FIG. 9, the base sidewall 114 includes a second groove 1142, a third communication hole 1144 and a fourth communication hole 1146. The second groove 1142 is recessed into the base sidewall 114 from a surface of the base sidewall 114. A sidewall of the second groove 1142 close to the accommodation space 210 is a third groove sidewall 193, and a sidewall of the second groove 1142 away from the accommodation space 210 is a fourth groove sidewall 194. The third communication hole 1144 is located in the third groove sidewall 193, and extends along a direction from the second groove 1142 to the accommodation space 210, so as to communicate the second groove 1142 with the accommodation space 210. The fourth communication hole 1146 is located in the fourth groove sidewall 194, and extends along a direction from the accommodation space 210 to the second groove 1142, so as to communicate the second groove 1142 with the external space.

In some examples, as illustrated by FIG. 9, the lighting module further includes a power line 180 located in the fourth communication hole 1146, the second groove 1142 and the third communication hole 1144; and the power line 180 extends from the fourth communication hole 1146 to the accommodation space 210 through the second groove 1142 and the third communication hole 1144, thereby supplying power to the light-emitting elements in the accommodation space. The lighting module further includes a sealing material 250 such as curable liquid glue, which is filled in the second groove 1142 to seal the second groove 1142. Therefore, the lighting module can seal the power line, and prevent external water and oxygen from entering the accommodation space through a through hole by which the power line enters the accommodation space, thereby further improving the waterproof performance of the lighting module.

Similarly, the second groove can be recessed into the base sidewall from a surface of the base sidewall away from the light-transmitting component body, and an orthographic projection of the second groove on a plane where the bottom plate is located is at least partially overlapped with an orthographic projection of the gap between the light-transmitting component sidewall and the base sidewall on the plane where the bottom plate is located. Since the second groove does not need to penetrate through the light-transmitting component sidewall, the orthographic projection of the second groove on the plane where the bottom plate is located is at least partially overlapped with the orthographic projection of the gap between the light-transmitting component sidewall and the base sidewall on the plane where the bottom plate is located, thereby reducing the width of the light-transmitting component sidewall.

Figure 10:
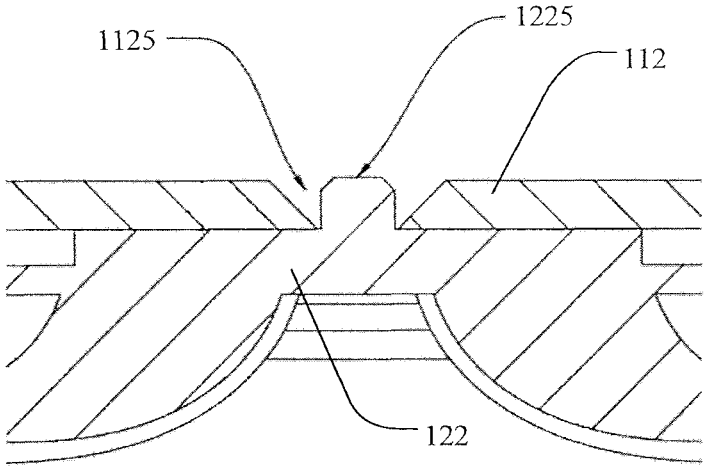
FIG. 10 is a partial structural diagram of another lighting module provided by an embodiment of the present disclosure.

FIG. 10 is a partial structural diagram of another lighting module provided by an embodiment of the present disclosure. As illustrated by FIG. 10, the light-transmitting component body 122 is provided with a positioning post 1225 protruding towards the bottom plate 112; the bottom plate 112 includes a positioning hole 1125 matched with the positioning post 1225; and the positioning post 1225 passes through the positioning hole 1125 to position the bottom plate 112. Therefore, during the assembling process, the lighting module can be positioned through the positioning post and the positioning hole, thereby reducing the manufacturing difficulty.

In some examples, as illustrated by FIG. 10, a size of a part of the positioning hole 1125 away from the light-transmitting component body 122 is larger than that of a part of the positioning hole 1125 close to the light-transmitting component body 122. For example, a cross section of the positioning hole 1125 in the direction perpendicular to the bottom plate may has a trapezoid shape.

Figure 11:
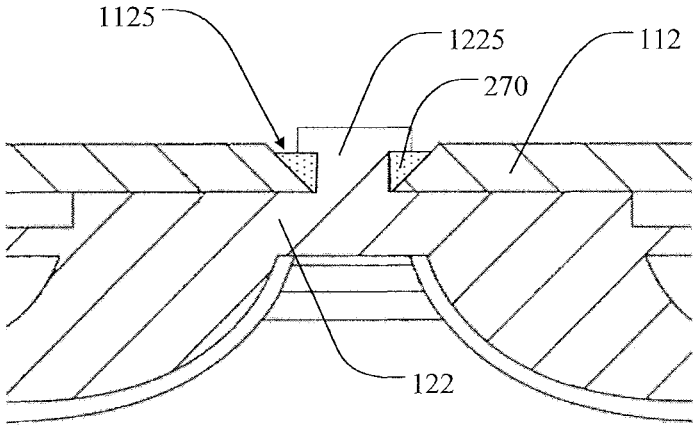
FIG. 11 is a partial structural diagram of another lighting module provided by an embodiment of the present disclosure.

FIG. 11 is a partial structural diagram of another lighting module provided by an embodiment of the present disclosure. As illustrated by FIG. 11, a size of a part of the positioning post 1225 away from the light-transmitting component body 122 is larger than that of a part of the positioning post 1225 close to the light-transmitting component body 122. Therefore, the positioning post 1225 can also function for fixing the light-transmitting component body 122, so as to prevent a middle part of the light-transmitting component body 122 from being arched and affecting light distribution.

For example, an initial state of the positioning post may be a cylinder with the same size. After the positioning post passes through the positioning hole, the part of the positioning post away from the light-transmitting component body is melted by means of hot melting, so that the size of the part away from the light-transmitting component body is larger than that of the part close to the light-transmitting component body, thereby achieving the function of fixing the light-transmitting component body.

In some examples, as illustrated by FIG. 11, a sealant 270 may be provided around the positioning post 1225 in the positioning hole 1125, so as to seal the positioning hole 1125.

Figure 12:
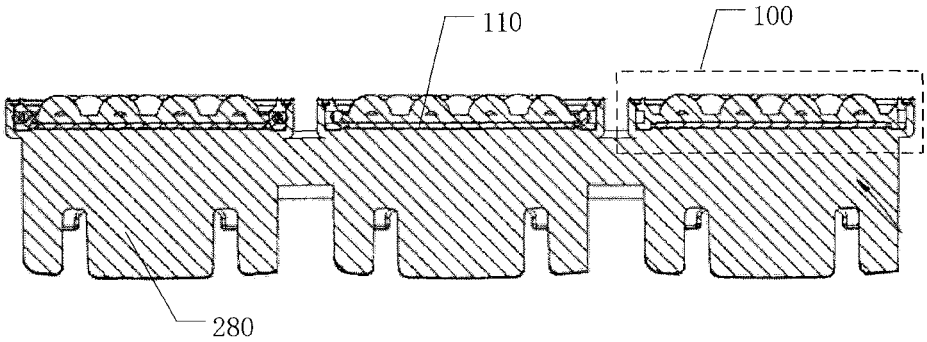
FIG. 12 is a structural diagram of a lighting device provided by an embodiment of the present disclosure.

An embodiment of the present disclosure also provides a lighting device. FIG. 12 is a structural diagram of a lighting device provided by an embodiment of the present disclosure. As illustrated by FIG. 12, the lighting device 200 includes any one of the lighting modules 100 described above. Therefore, the lighting device also has the beneficial effects corresponding to those of the lighting module described above, and the repeated portions are omitted in the present disclosure. For more details, reference may be made to the related description of the lighting module.

In some examples, the lighting device can be a street lighting device, a stadium lighting device, an airport lighting device and the like.

In some examples, as illustrated by FIG. 12, the lighting device 200 includes a plurality of lighting modules 100 and a heat sink 280. The bases 110 of the plurality of lighting modules 100 are fixed on the heat sink 280 to collectively dissipate heat through the heat sink 280.

The following statements need to be explained:

(1) In the drawings of the embodiments of the present disclosure, only the structures related to the embodiments of the present disclosure are involved, and other structures may refer to the common design(s).

(2) For clarity, in the drawings for describing embodiments of the present disclosure, the thickness and size of the layer or microstructure are amplified. It is understood that when elements such as layers, membranes, regions, or circuit boards are called "up" or "down" of another element, the element can be "directly" on or down another element, or there may be intermediate elements.

(3) In case of no conflict, features in one embodiment or in different embodiments of the present disclosure can be combined.

The above are merely particular embodiments of the present disclosure but are not limitative to the scope of the present disclosure; any of those skilled familiar with the related arts can easily conceive variations and substitutions in the technical scopes disclosed in the present disclosure, which should be encompassed in protection scopes of the present disclosure. Therefore, the scopes of the present disclosure should be defined in the appended claims.

What is claimed is:

1. A lighting module, comprising:

a base, comprising a bottom plate and a base sidewall;

a light-transmitting component, comprising a light-transmitting component body and a light-transmitting component sidewall; and a sealing component, wherein the bottom plate and the light-transmitting component body are disposed opposite to each other to form an accommodation space between the bottom plate and the light-transmitting component body; the base sidewall and the light-transmitting component sidewall are disposed opposite to each other in a direction parallel to the base plate; the sealing component is located between the base sidewall and the light-transmitting component sidewall, and is in close contact with the light-transmitting component sidewall and the base sidewall, respectively, so as to seal the accommodation space, the light-transmitting component sidewall is located at an edge of the light-transmitting component body and extends along a direction from the light-transmitting component body towards the bottom plate, an accommodation groove is formed by the light-transmitting component sidewall and the light-transmitting component body, and the base is at least partially located in the accommodation groove, the light-transmitting component sidewall is located at a side of the base sidewall away from a center of the bottom plate.

2. The lighting module according to claim 1, wherein the base sidewall is a part of the bottom plate close to the light-transmitting component sidewall.

3. A lighting module, comprising:

a base, comprising a bottom plate and a base sidewall;

a light-transmitting component, comprising a light-transmitting component body and a light-transmitting component sidewall; and a sealing component, wherein the bottom plate and the light-transmitting component body are disposed opposite to each other to form an accommodation space between the bottom plate and the light-transmitting component body; the base sidewall and the light-transmitting component sidewall are disposed opposite to each other in a direction parallel to the base plate; the sealing component is located between the base sidewall and the light-transmitting component sidewall, and is in close contact with the light-transmitting component sidewall and the base sidewall, respectively, so as to seal the accommodation space, the base sidewall is located at an edge of the bottom plate and extends along a direction from the bottom plate towards the light-transmitting component body, an accommodation groove is formed by the bottom plate and the base sidewall, and the light-transmitting component is at least partially located in the accommodation groove, the base sidewall is located at a side of the light-transmitting component sidewall away from a center of the bottom plate.

4. The lighting module according to claim 1, wherein the sealing component comprises a sealant filled between the base sidewall and the light-transmitting component sidewall.

5. The lighting module according to claim 4, wherein the sealant is only located in a gap between the light-transmitting component sidewall and the base sidewall.

6. The lighting module according to claim 1, wherein the sealing component comprises a sealing ring at least partially located between the base sidewall and the light-transmitting component sidewall, and the light-transmitting component sidewall is configured to apply a force, towards the base sidewall, to the sealing ring so that the sealing ring is in a compressed state.

7. The lighting module according to claim 6, wherein the sealing ring comprises:

a first sealing portion located between the base sidewall and the light-transmitting component sidewall; and a second sealing portion connected with the first sealing portion and located between the bottom plate and the light-transmitting component body, wherein a cross section of the sealing ring constituted by the first sealing portion and the second sealing portion has an "L" shape.

8. The lighting module according to claim 6, wherein the sealing ring comprises:

a first sealing portion located between the base sidewall and the light-transmitting component sidewall;

a second sealing portion connected with the first sealing portion and located between the bottom plate and the light-transmitting component body; and a third sealing portion connected with the first sealing portion and located at a side of the light-transmitting component body away from the bottom plate, wherein a cross section of the sealing ring constituted by the first sealing portion, the second sealing portion and the third sealing portion has a "U" shape.

9. The lighting module according to claim 1, wherein the light-transmitting component sidewall comprises:

a first groove recessed into the light-transmitting component sidewall from a surface of the light-transmitting component sidewall, wherein a sidewall of the first groove close to the accommodation space is a first groove sidewall, and a sidewall of the first groove away from the accommodation space is a second groove sidewall;

a first communication hole, located in the first groove sidewall and extending along a direction from the first groove to the accommodation space, so as to communicate the first groove with the accommodation space; and a second communication hole, located in the second groove sidewall and extending along a direction from the accommodation space to the first groove, so as to communicate the first groove with an external space.

10. The lighting module according to claim 9, further comprising:

a power line, located in the second communication hole, in the first groove and in the first communication hole, and extending from the second communication hole to the accommodation space through the first groove and the first communication hole; and a sealing material, filled in the first groove so as to seal the first groove.

11. The lighting module according to claim 9, wherein the first groove is recessed into the light-transmitting component sidewall from a surface of the light-transmitting component sidewall away from the bottom plate, and an orthographic projection of the first groove on a plane where the bottom plate is located is at least partially overlapped with an orthographic projection of a gap between the light-transmitting component sidewall and the base sidewall on the plane where the bottom plate is located.

12. The lighting module according to claim 9, wherein the first groove is recessed into the light-transmitting component sidewall from a surface of the light-transmitting component sidewall close to the bottom plate, and an orthographic projection of the first groove on a plane where the bottom plate is located is spaced apart from an orthographic projection of a gap between the light-transmitting component sidewall and the base sidewall on the plane where the bottom plate is located.

13. The lighting module according to claim 3, wherein the base sidewall comprises:

a second groove recessed into the base sidewall from a surface of the base sidewall, wherein a sidewall of the second groove close to the accommodation space is a third groove sidewall, and a sidewall of the second groove away from the accommodation space is a fourth groove sidewall;

a third communication hole, located in the third groove sidewall and extending along a direction from the second groove to the accommodation space, so as to communicate the second groove with the accommodation space; and a fourth communication hole, located in the fourth groove sidewall and extending along a direction from the accommodation space to the second groove, so as to communicate the second groove with an external space.

14. The lighting module according to claim 13, further comprising:

a power line, located in the fourth communication hole, in the second groove and in the third communication hole, and extending from the fourth communication hole to the accommodation space through the second groove and the third communication hole; and a sealing material, filled in the second groove so as to seal the second groove.

15. A lighting module, comprising:

a base, comprising a bottom plate and a base sidewall;

a light-transmitting component, comprising a light-transmitting component body and a light-transmitting component sidewall; and a sealing component, wherein the bottom plate and the light-transmitting component body are disposed opposite to each other to form an accommodation space between the bottom plate and the light-transmitting component body; the base sidewall and the light-transmitting component sidewall are disposed opposite to each other in a direction parallel to the base plate; the sealing component is located between the base sidewall and the light-transmitting component sidewall, and is in close contact with the light-transmitting component sidewall and the base sidewall, respectively, so as to seal the accommodation space, the light-transmitting component sidewall comprises:

a first sidewall, disposed opposite to the base sidewall in a direction parallel to the bottom plate;

a second sidewall, disposed opposite to the base sidewall in the direction parallel to the bottom plate, and located at a side of the first sidewall close to the light-transmitting component body; and a first platform, connected with the first sidewall and the second sidewall, respectively, wherein the first sidewall and the base sidewall are disposed opposite to each other to form a first gap between the first sidewall and the base sidewall, and the second sidewall and the base sidewall are disposed opposite to each other to form a second gap between the second sidewall and the base sidewall, wherein a width of the first gap is greater than a width of the second gap.

16. The lighting module according to claim 15, wherein the base sidewall comprises:

a third sidewall, disposed opposite to the first sidewall to form a third gap between the first sidewall and the third sidewall;

a fourth sidewall, disposed opposite to the second sidewall to form the second gap between the second sidewall and the fourth sidewall; and a second platform, connected with the third sidewall and the fourth sidewall, respectively, wherein a width of the third gap is greater than the width of the first gap.

17. The lighting module according to claim 1, further comprising:

a circuit board, located in the accommodation space; and at least one light-emitting element, located on the circuit board and configured to emit light towards the light-transmitting component, wherein the light-transmitting component comprises at least one lens portion, and the at least one lens portion is arranged in one-to-one correspondence with the at least one light-emitting element.

18. The lighting module according to claim 17, wherein the bottom plate and the circuit board are integrated into a whole.

19. A lighting device, comprising:

a plurality of lighting modules, each of which is the light module according to claim 1; and a heat sink, wherein bases of the plurality of lighting modules are fixed on the heat sink so as to collectively dissipate heat through the heat sink.

* * * * *